US007216570B2

(12) United States Patent
Seber et al.

(10) Patent No.: US 7,216,570 B2
(45) **Date of Patent: *May 15, 2007**

(54) SWITCHABLE SELF-ADJUSTING PLIERS

(75) Inventors: Brett P. Seber, Escondido, CA (US); Eric B. Carmichael, Encinitas, CA (US)

(73) Assignee: I.D.L. Tech Tools, LLC, Summit, NJ (US)

( * ) Notice: Subject to any disclaimer, the term of this patent is extended or adjusted under 35 U.S.C. 154(b) by 0 days.

This patent is subject to a terminal disclaimer.

(21) Appl. No.: 10/929,717

(22) Filed: Aug. 31, 2004

(65) Prior Publication Data

US 2005/0160883 A1 Jul. 28, 2005

Related U.S. Application Data

(63) Continuation of application No. 10/463,843, filed on Jun. 18, 2003, now Pat. No. 7,100,479, which is a continuation-in-part of application No. 09/942,095, filed on Aug. 28, 2001, now Pat. No. 6,748,829, which is a continuation of application No. 09/594,191, filed on Jun. 14, 2000, now Pat. No. 6,279,431, which is a continuation-in-part of application No. 09/334,055, filed on Jun. 15, 1999, now Pat. No. 6,212,978.

(60) Provisional application No. 60/390,007, filed on Jun. 18, 2002.

(51) Int. Cl.
*B25B 7/12* (2006.01)
*B25B 7/14* (2006.01)

(52) U.S. Cl. ..... 81/357; 81/368; 81/372

(58) Field of Classification Search ..... 81/357, 81/355, 358–361, 364, 342, 367–372, 373–380
See application file for complete search history.

(56) References Cited

U.S. PATENT DOCUMENTS 2,201,918 A * 5/1940 Petersen ..... 81/372
2,428,949 A 10/1947 Ward et al.

(Continued)

FOREIGN PATENT DOCUMENTS

FR 1264672 5/1961

*Primary Examiner*—Hadi Shakeri
(74) *Attorney, Agent, or Firm*—Lerner, David, Littenberg, Krumholz & Mentlik, LLP

(57) ABSTRACT

A self-adjusting pliers is operable to grasp a workpiece between an upper jaw and a lower jaw. The pliers includes an upper arm having a first end and a second end, with the upper jaw at the first end. A jaw arm has a first end and a second end. The second end of the jaw arm is pivotably connected to the upper arm at a main pivot adjacent to the second end of the upper arm, so that the first end of the jaw arm is movable in a circular arc relative to the main pivot. The lower jaw is at the first end of the jaw arm in movable facing relation to the upper jaw so that the workpiece may be grasped between the upper jaw and the lower jaw. An engagement mechanism releasably engages the jaw arm to the upper arm at an engagement position responsive to a movement of the jaw arm relative to the upper arm and responsive to a size of the workpiece grasped between the upper jaw and the lower jaw, to thereby prevent rotation of the jaw arm relative to the upper arm.

22 Claims, 8 Drawing Sheets

U.S. PATENT DOCUMENTS

| | | | | | |
|---|---|---|---|---|---|
| 2,450,791 | A | | 10/1948 | Hagen | |
| 2,521,276 | A | | 9/1950 | Lampe | |
| 2,592,803 | A | * | 4/1952 | Heim | 81/344 |
| 2,669,145 | A | * | 2/1954 | Mead | 81/370 |
| 3,195,382 | A | * | 7/1965 | Rommel et al. | 81/373 |
| 3,208,319 | A | | 9/1965 | Westby et al. | |
| 3,241,410 | A | | 3/1966 | Paden | |
| 3,379,079 | A | | 4/1968 | Cutter | |
| 3,672,245 | A | | 6/1972 | Hoffman | |
| 3,884,100 | A | | 5/1975 | Fideldy | |
| 4,147,077 | A | | 4/1979 | Tasato | |
| 4,541,312 | A | | 9/1985 | Petersen | |
| 4,651,598 | A | | 3/1987 | Warheit | |
| 4,662,252 | A | | 5/1987 | Warheit | |
| 4,730,524 | A | | 3/1988 | Petersen | |
| 4,744,272 | A | | 5/1988 | Leatherman | |
| 4,802,390 | A | | 2/1989 | Warheit | |
| 4,922,770 | A | | 5/1990 | Dlugolecki et al. | |
| 5,020,399 | A | | 6/1991 | Annis et al. | |
| 5,022,290 | A | | 6/1991 | Duffy | |
| 5,351,584 | A | | 10/1994 | Warheit | |
| 5,351,585 | A | * | 10/1994 | Leseberg et al. | 81/426 |
| 5,385,072 | A | * | 1/1995 | Neff | 81/405 |
| 5,408,904 | A | | 4/1995 | Neff | |
| 5,491,856 | A | | 2/1996 | Legg | |
| 5,535,650 | A | | 7/1996 | McNatt | |
| 5,609,080 | A | | 3/1997 | Flavigny | |
| 6,014,917 | A | | 1/2000 | Bally et al. | |
| 6,065,376 | A | | 5/2000 | Khachatoorian | |
| 6,212,978 | B1 | | 4/2001 | Seber et al. | |
| 6,227,081 | B1 | | 5/2001 | Bally et al. | |
| 6,279,431 | B1 | | 8/2001 | Seber et al. | |
| 6,467,380 | B1 | | 10/2002 | Azkona | |
| 6,658,971 | B2 | | 12/2003 | Delbrugge, Jr. et al. | |
| 6,748,829 | B2 | | 6/2004 | Seber et al. | |

* cited by examiner

SWITCHABLE SELF-ADJUSTING PLIERS

CROSS-REFERENCE TO RELATED APPLICATIONS

This application is a continuation of U.S. application Ser. No. 10/463,843, filed Jun. 18, 2003, now U.S. Pat. No. 7,100,479 which claims the benefit of U.S. Provisional Application No. 60/390,007 filed Jun. 18, 2002 and which is a continuation-in-part of U.S. application Ser. No. 09/942,095, filed Aug. 28, 2001, now U.S. Pat. No. 6,748,829, which is a continuation of U.S. application Ser. No. 09/594,191, filed Jun. 14, 2000, now U.S. Pat. No. 6,279,431, which is a continuation-in-part of U.S. application Ser. No. 09/334,055, filed Jun. 15,1999, now U.S. Pat. No. 6,212,978. The disclosure of each of the above-identified applications is incorporated herein by reference.

FIELD OF INVENTION

This invention relates to pliers, and, more particularly, to a self-adjusting pliers that grips workpieces of various sizes without manual adjustment.

BACKGROUND OF THE INVENTION

The traditional version of a pliers includes two elongated members jointed at a pivot pin. One end of each elongated member forms a jaw, and the other end forms a handle. Workpieces of different sizes are grasped in different manners, due to the constant geometry of the elongated members and the jaws. Some adjustability may be achieved by providing a slotted receiver in one of the handles, so that the handle with the pivot pin may be moved between different positions in the slot to provide adjustability for gripping objects of different sizes.

U.S. Pat. No. 4,651,598, for example, provides a pliers whose jaws are self adjusting according to the size of the workpiece. Commercial versions of this pliers are useful, but have significant drawbacks. Perhaps the most significant problem with the pliers made according to the '598 patent is that the jaws move slightly relative to each other in an end-to-end manner as they are clamped down onto a workpiece. The surfaces of soft workpieces such as brass or copper may be marred as a result. In addition, the clamping force applied by these pliers depends upon the size of the workpiece being grasped.

Another problem with the pliers of the '598 patent is that they do not lock to the workpiece, an important convenience in some uses of pliers. However, overcenter locking pliers are conventional, and are described, for example, in a series of patents such as U.S. Pat. No. 4,541,312. Such conventional overcenter locking pliers provide adjustability in the size of the workpiece that may be gripped through a screw adjustment to the pivoting position of the control arm, but this adjustability is not automatic in the sense of the pliers of the '598 patent.

Other types of locking pliers such as the AutoLock™ pliers combine the self-adjusting feature with an overcenter locking mechanism. These pliers can be inconvenient to use for some sizes of workpieces, suffers from some of the problems of the pliers of the '598 patent, does not achieve a large gripping force, and may unexpectedly unlock when large objects are being gripped. Additionally, as with some other pliers, two hands are required for its operation.

There is a need for a self-adjusting pliers which does not experience shifting of the jaw position as the object is grasped, which may be operated with one hand, and which may be provided in a locking version. The present invention fulfills this need.

SUMMARY OF THE INVENTION

The present invention provides a self-adjusting pliers wherein the jaws automatically adjust to various sizes of workpieces. There is no end-to-end relative movement of the jaws as they grasp the workpiece, so that there can be no surface marring of the type observed with the pliers of the '598 patent. The clamping force is substantially constant regardless of the size of the workpiece, but is adjustable in some versions of the pliers. The clamping force against the workpiece is multiplied several times by the mechanism, leading to a much higher maximum available clamping force than possible with conventional pliers. The pliers may be provided with no locking or with releasable overcenter locking, or with the ability to switch between the two. The self-adjusting pliers is operable with one hand.

In accordance with the invention, a self-adjusting pliers is operable to grasp a workpiece between an upper jaw and a lower jaw. The pliers includes an upper arm having a first end and a second end. The upper jaw is at the first end of the upper arm. A jaw arm has a first end and a second end. The second end of the jaw arm is pivotably connected to the upper arm at a main pivot adjacent to the second end of the upper arm, so that the first end of the jaw arm is movable in a circular arc relative to the main pivot. The lower jaw is located at the first end of the jaw arm in movable facing relation to the upper jaw as the jaw arm pivots about the main pivot, so that the workpiece may be grasped between the upper jaw and the lower jaw. An engagement mechanism releasably engages the jaw arm to the upper arm at an engagement position responsive to a movement of the jaw arm relative to the upper arm and responsive to a size of the workpiece grasped between the upper jaw and the low jaw. Further gross rotation of the jaw arm relative to the upper arm is thereby prevented until the engagement to the workpiece is released. The upper jaw and the lower jaw are each preferably of a multilayer metallic construction.

Preferably, there is a support integral with, and extending from the upper arm toward and past the jaw arm. The support includes a support engagement curved in a circular arc centered about the main pivot. The support engagement desirably includes an engagement slot or channel in the support, and a restraining plate to restrain, guide, position, and align some of the components of the engagement mechanism. There is additionally a lower arm that is linked to the jaw arm at a location adjacent to the lower jaw, but that is not integral with the jaw arm. A control arm has a first end and a second end. The first end of the control arm is pivotably connected to the jaw arm at an upper control-arm pivot pin adjacent to the second end of the jaw arm. The second end of the control arm is pivotably connected to the lower arm at a lower control-arm pivot pin at a location along the length of the lower arm. A lower-arm spring biases the lower arm so as to resist rotation of the lower arm about the upper control-arm pivot pin.

The engagement mechanism desirably includes a shifter and a pawl that is pivotably supported on the shifter. The shifter is operable to engage the pawl to the upper arm, and specifically to the downwardly extending support, at the engagement position responsive to the movement of the jaw arm relative to the upper arm and responsive to the size of the workpiece grasped between the upper jaw and the lower jaw. The shifter transmits a locking and engaging force applied through the lower arm to the lower jaw and also engages the pawl to the support engagement slot responsive to the movement of the jaw arm relative to the upper arm and responsive to the size of the workpiece grasped between the upper jaw and the lower jaw. The shifter is pivotable relative to the jaw arm and is rotatable relative to the lower arm, and the pawl is pivotably supported on the shifter.

The engagement mechanism releasably engages the jaw arm to the upper arm. There also may be a locking mechanism that releasably locks the jaw arm to the upper arm, and specifically to the downwardly extending support, at the engagement position. Some versions of the pliers are controllably alterable between the releasable-engagement type and the releasable engagement-and-lock type by the operation of a locking engagement control. In one design, a locking-engagement control of the locking mechanism interferes with a rotation of the control arm about the upper control-arm pivot pin in the releasable-engagement embodiment, but does not interfere with rotation of the control arm about the upper control-arm pivot pin in the releasable engagement-and-lock embodiment.

In one form, the pliers includes a releasable overcenter lock for the jaws. In this version, there is a downwardly extending lobe on the control arm. A release arm is pivotably connected to the lower arm and has a release pad disposed to contact the lobe of the control arm when the release arm is pivoted. In operation, the control arm moves to an overcenter position when the clamping force is fully applied. This overcenter position may be released to unlock the jaws from the workpiece either by pulling the handles apart, or by manually pivoting the release arm. The overcenter locking is readily released by pulling the upper arm and the lower arm apart when the clamping force is small, but is more conveniently released by operating the release arm when the clamping force is large.

The maximum magnitude of the clamping force applied to the workpiece may be much larger than possible with conventional pliers, due to a force multiplication effect present in the mechanism. The length of the arms, the angle between the control arm and the lower arm, the relative location of the shifter pivot points, and the movement of the shifter relative to the jaw mechanism all contribute to a leveraged multiplication of the force applied though the handles. The multiplication factors are established by the structural geometry built into the pliers.

The pliers may be provided with control over the clamping force applied to the workpiece through the jaws. A manual force adjuster acting on the control arm is provided at a location adjacent to the second end of the upper arm. The manual force adjuster is operable to move the upper control-arm pivot pin along the jaw arm. This movement of the pivot point of the first end of the control arm changes its angle and position relative to the lower arm and to the jaw arm, with the result that the maximum clamping force applied through the jaws is controllably variable. It is preferred to combine the features of both the manual force adjuster and the releasable overcenter lock in a single pliers, when either feature is provided.

In operation, with the jaws separated and not contacting the workpiece, the jaw arm, the lower arm, the control arm, and the engagement mechanism initially rotate relative to the upper arm as an interconnected unit about the main pivot. An anti-squat mechanism aids in maintaining the fixed geometrical relationship of these elements during the initial rotation. A main spring reacts between this interconnected unit and the upper arm, and specifically between the jaw arm and the upper arm. The main spring weakly biases the interconnected unit away from the upper arm to initially keep the jaws separated. The hand force applied by the user through the upper arm and the lower arm overcomes this biasing to move the jaws toward contact with the workpiece. When the jaws contact the workpiece, the shifter begins to rotate to apply the hand force of the user to the workpiece as the clamping force. As the contact pressure increases further, the force multiplication effect comes into play to produce a clamping force that is greater than the user would otherwise produce. The workpiece is thereby clamped between the jaws with a maximum clamping force that is controllable through the force adjuster. Release of the hand force by the user reverses the process.

The mechanism of the invention is operable to move the lower jaw upwardly along the downwardly extending guide until the lower jaw contacts the workpiece, and to then engage the jaw arm to the upper arm and to transfer a clamping force to the lower jaw. The clamping mechanism is thus self-adjusting to accommodate any size workpiece that will fit between the jaws.

The pliers described above preferably includes an overcenter lock switch mechanism in the lower handle which is movable between a first locking position and a second non-locking position. In the first position the overcenter lock switch mechanism allows the pivoting movement of the lower arm relative to the control arm prior to reaching an overcenter lock position, while in the second non-locking position the overcenter lock switch mechanism prevents the control arm from reaching an overcenter lock position. The movement of the locking switch mechanism to the second switch position thus prevents the pivoting movement of the lower arm and the control arm from reaching an overcenter locking position, and thereby prevents the overcenter locking function.

In one form of the invention, the lock switch mechanism is a slidable lock which is movable to interfere with the operation of a release arm. The release arm is mounted on the lower handle and when the switch is in the lock position the release arm is pivoted to a release position by the control arm when the control arm moves to its overcenter locking position. The release arm may then be operated to move the control arm out of the overcenter locking position to unlock the plier. To prevent locking, the switch is moved to a no-lock position where it prevents the release arm from pivoting to the release position, thereby preventing the control arm from moving to its overcenter locking position.

In another form of the invention, the lock switch mechanism is a slidable lock selector, or locking engagement controller, which includes a pin on the release arm which is slidable in a track on the lower handle to allow the release arm to be moved between lock and no-lock positions. When the selector is in the no-lock position, a blocking pad on the release arm engages a lobe on the control arm to prevent the control arm from moving to an overcenter locking position. To permit locking of the pliers, the lock selector is moved to its lock position which moves the blocking pad out of the path of the control arm lobe, allowing the control arm to move to its overcenter locking position. The release arm also includes a release pad which engages the lobe in the lock position to enable release of the control arm.

In a related form of the invention, the overcenter lock switch mechanism includes an overcenter limiting arm affixed to the lower arm of the pliers, as by a slider pin in a slot. The limiting arm includes a contact surface which can be moved toward or away from a control arm lobe to prevent or to allow the overcenter locking operation.

Other features and advantages of the present invention will be apparent from the following more detailed description of preferred embodiments, taken in conjunction with the accompanying drawings, which illustrate, by way of example, the principles of the invention. The scope of the invention is not, however, limited to this preferred embodiment.

DETAILED DESCRIPTION OF THE INVENTION

Figure 1:
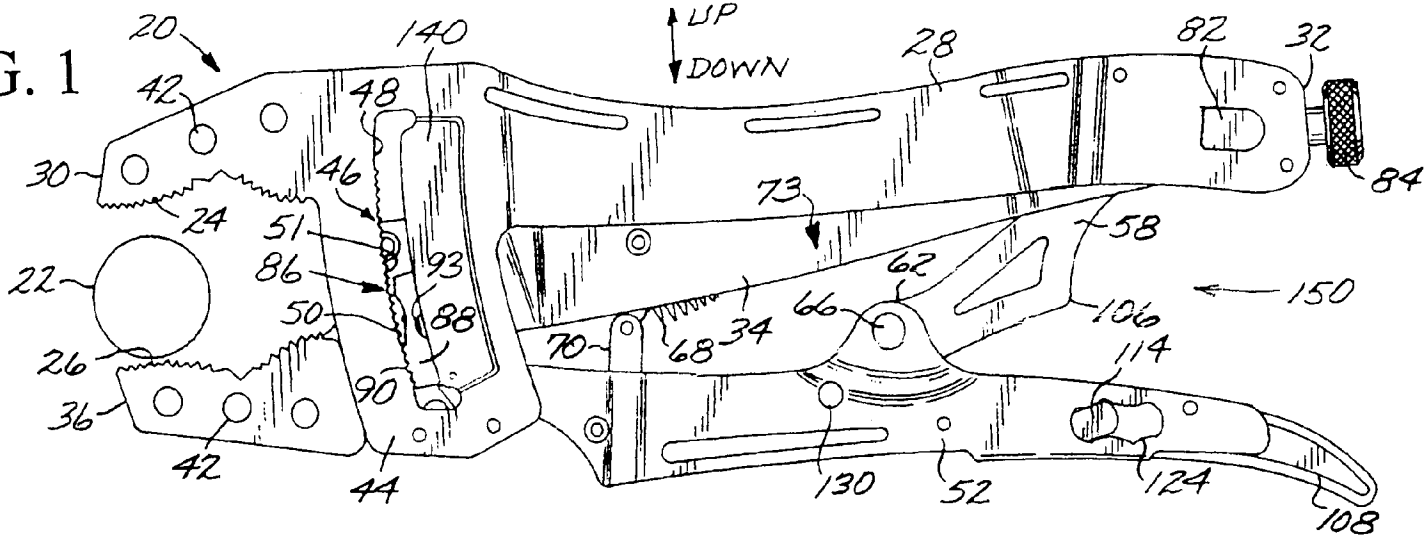
FIG. 1 is an elevational view of a pliers.
Figure 3:
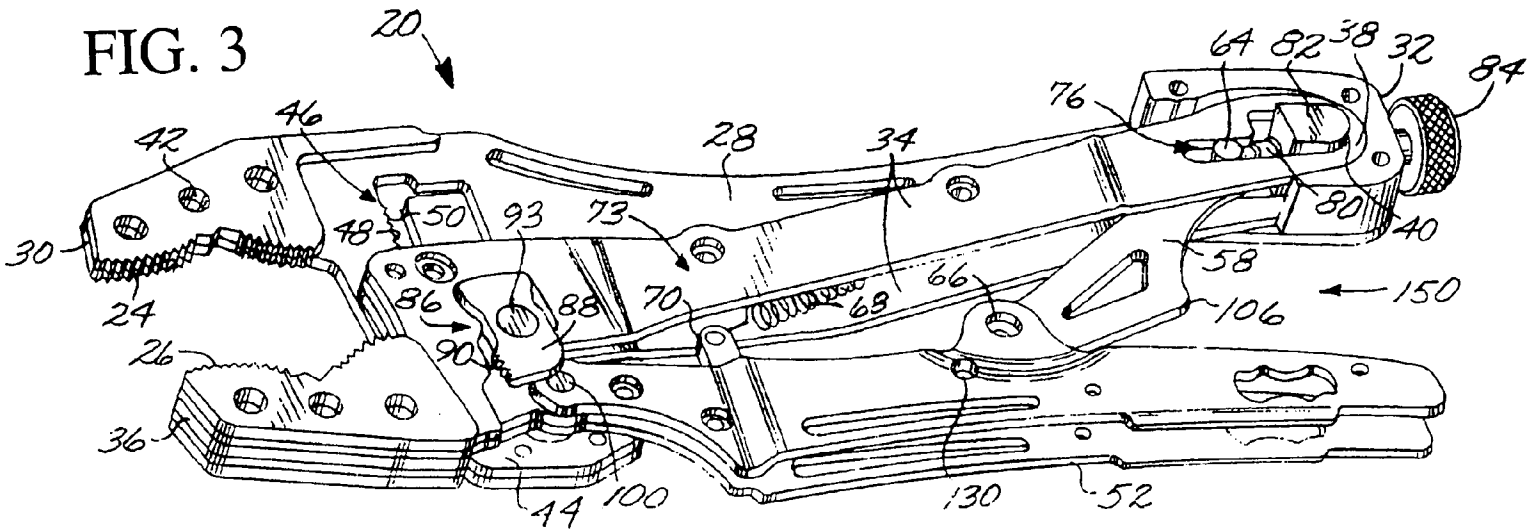
FIG. 3 is a schematic perspective view of the pliers of FIG. 1, with additional portions of the external structure removed.
Figure 2:
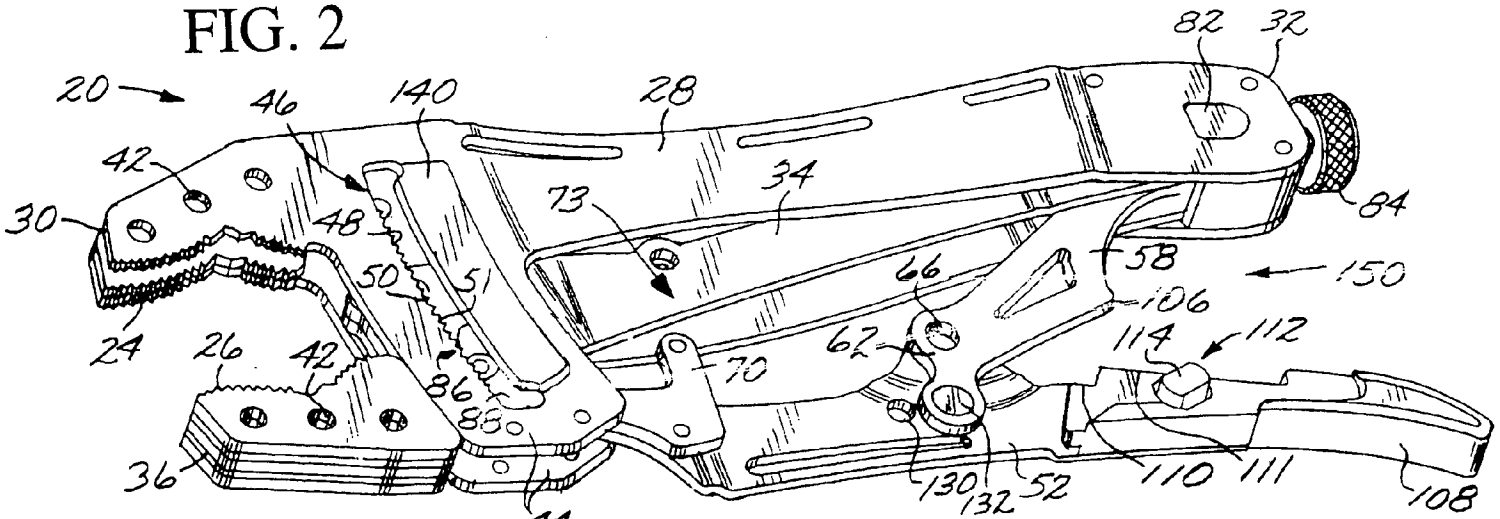
FIG. 2 is a schematic perspective view of the pliers of FIG. 1, with portions of the external structure removed.
Figure 4:
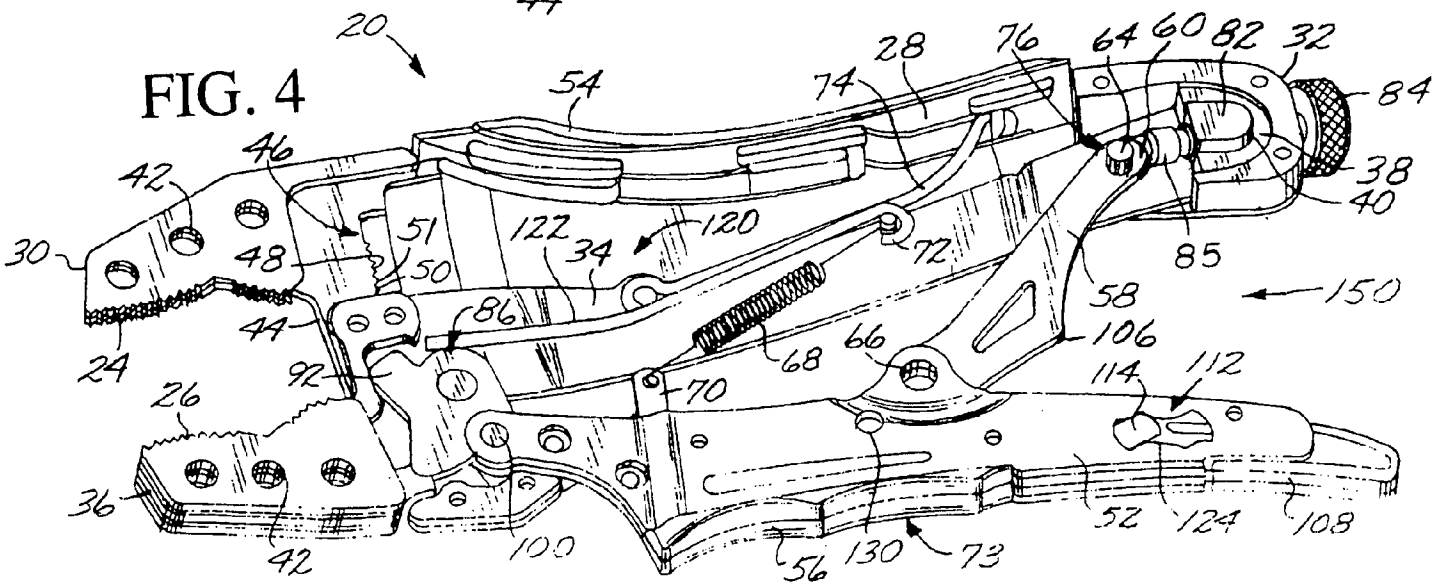
FIG. 4 is a schematic perspective view of the pliers of FIG. 1, with further portions of the external structure removed.
Figure 5:
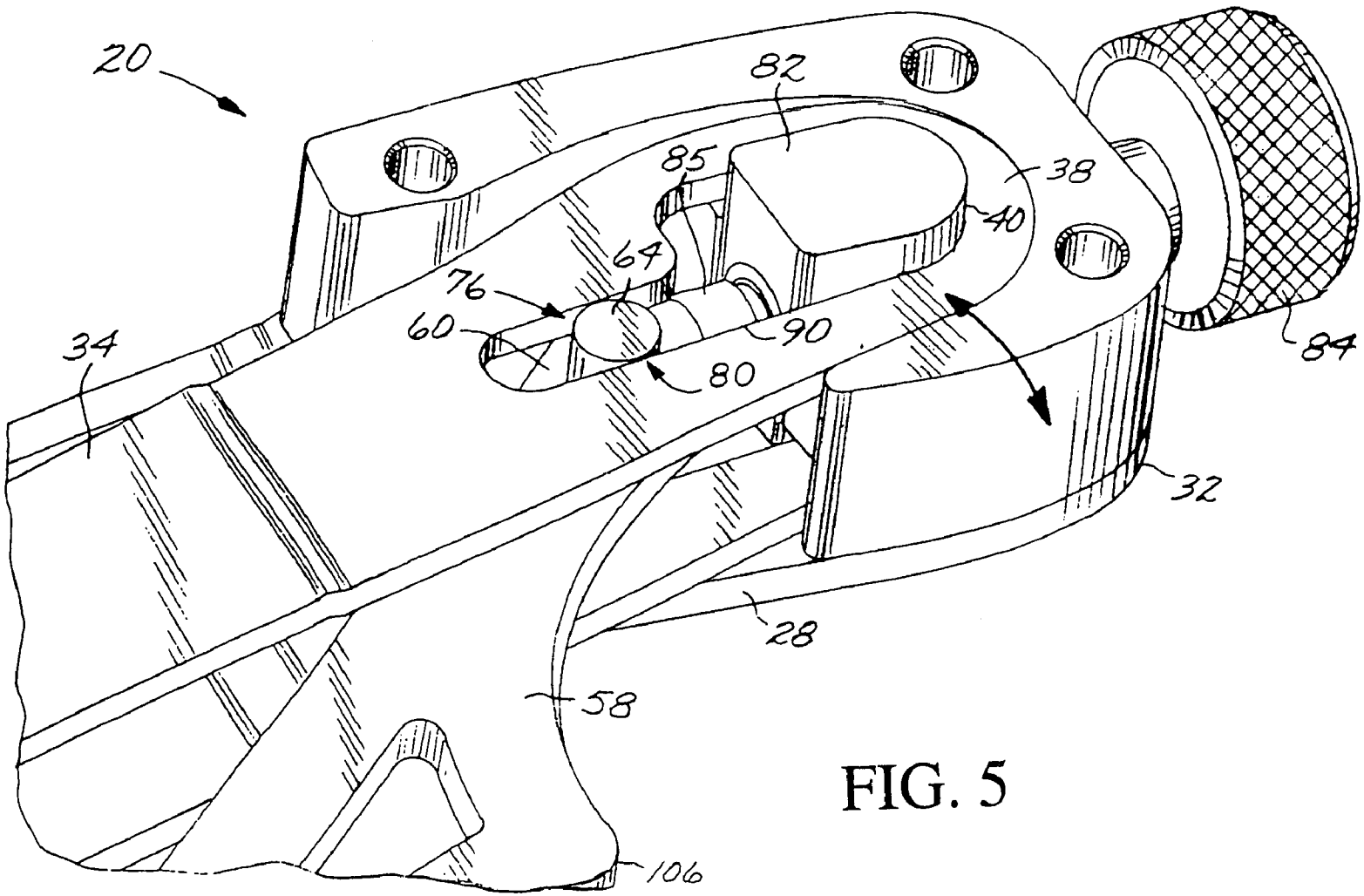
FIG. 5 is a detail perspective view near the second end of the upper arm of the pliers of FIG. 1.
Figure 6:
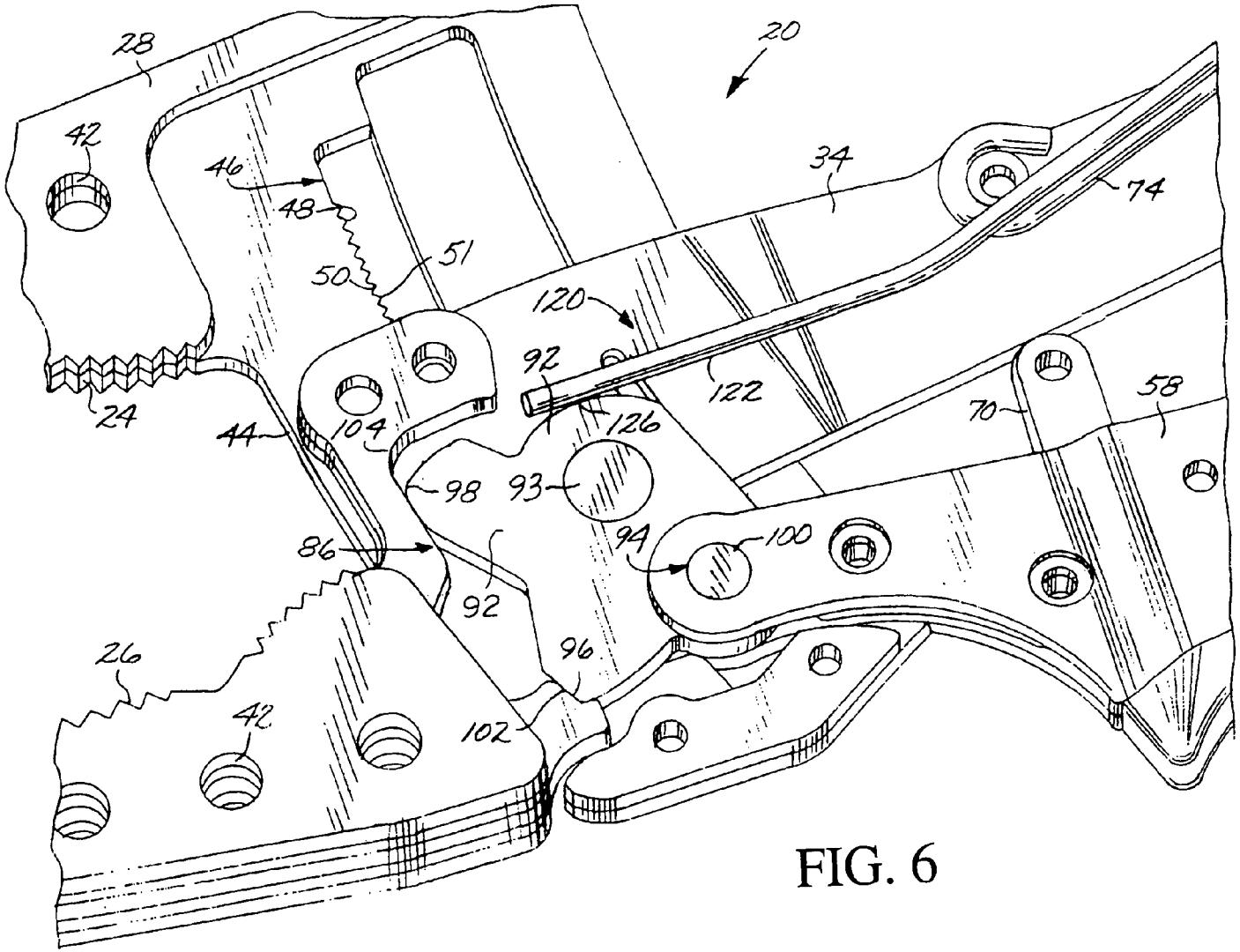
FIG. 6 is a detail perspective view in the region of the shifter of the pliers of FIG. 1.

FIGS. 1–6 illustrate a self-adjusting pliers 20 according to the invention. FIG. 1 is an elevational view, and FIGS. 2–4 show the same pliers 20 with portions of the structure progressively removed to illustrate the internal structure and mechanics. FIGS. 5–6 illustrate details. "Up" and "down" reference directions are indicated on several of the figures and apply to all of the embodiments. In the figures, rivets that are present to hold the structure together are not shown because their heads tend to obscure the views of the relevant structure. The appropriate rivet holes are visible.

As illustrated in FIG. 1, the self-adjusting pliers 20 is a hand tool that is operable to grasp a workpiece 22 between an upper jaw 24 and a lower jaw 26. An upper arm 28 has a first end 30 and a second end 32. The upper jaw 24 is at the first end 30 of the upper arm 28, and is integral with the remainder of the upper arm 28 in the depicted embodiment.

As best seen in FIG. 3, a jaw arm 34 has a first end 36 and a second end 38. The second end 38 of the jaw arm 34 is pivotable relative to the upper arm 28 on a main pivot 40 adjacent to the second end 32 of the upper arm 28. The main pivot 40 is a segment of a circle defined on a pivot block 82 that is fixedly supported between the sides of the upper arm 28. The first end 36 of the jaw arm 34 is therefore movable in a circular arc relative to the center defined by the main pivot 40. The upper arm 28 is a generally U-shaped channel over most of its length with the opening of the U facing downwardly, so that the jaw arm 34 may be received between the sides of the upper arm 28 as the jaw arm 34 pivots. The lower jaw 26 is at the first end 36 of the jaw arm 34 in movable facing relation to the upper jaw 24. As the jaw arm 34 pivots about the main pivot 40, reducing the distance between the jaws 24 and 26, the workpiece 22 is grasped between the upper jaw 24 and the lower jaw 26. As seen in FIGS. 2–4, in the preferred embodiment the upper jaw 24 and the lower jaw 26 are each preferably of a multilayer metallic construction. That is, each of the jaws 24 and 26 is made by stacking appropriately shaped thin metallic plates, and attaching them together with rivets extending through transverse rivet holes 42 in the jaws 24 and 26. Similarly, in this embodiment the arms are made of overlying plates. In other embodiments, the jaws may be made of solid, non-laminated metal, and some of the arms may be made as a single piece of metal formed into a U-shaped channel, as appropriate.

A support 44 is integral with and extends downwardly from the upper arm 28 toward and past the jaw arm 34. The support 44 includes a support engagement 46 therein, curved in a circular arc centered about the center of the main pivot. The support engagement slot 48 desirably includes small support engagement teeth 50 along a side 51 of the slot 48 nearest the jaw 24 and 26.

A lower arm 52 is linked to the jaw arm 34 at a location adjacent to the lower jaw 26. The lower arm 52 is not integral with the jaw arm 34. The lower arm 52 extends generally parallel to the upper arm 28. The upper arm 28 and the lower arm 52 are grasped by the hand of the user of the pliers 20, and an upper arm pad 54 and a lower arm pad 56 are provided in their outwardly facing surfaces to facilitate this grasping and aid in the user positioning the grasping hand correctly. The upper arm 28 and the lower arm 52 thereby serve as the handles grasped by the user of the pliers 20.

A control arm 58 has a first end 60 and a second end 62. The first end 60 of the control arm 58 is pivotably connected to the jaw arm 34 at an upper control-arm pivot pin 64 adjacent to the second end 38 of the jaw arm 34. The upper control-arm pivot pin 64 extends between the sides of the jaw arm 34. The second end 62 of the control arm 58 is pivotably connected to the lower arm 52 at a lower control-arm pivot point 66 that is positioned at a location, in this case an intermediate location, along the length of the lower arm 52.

A lower-arm spring 68 biases the lower arm 52 so as to resist rotation of the lower arm 52 about the upper control arm pivot point 64. In the illustrated embodiment, the lower-arm spring 68 is a coil spring connected between a projection 70 on the lower arm 52 and an intermediate location 72 on the jaw arm 34.

In operation, the jaw arm 34, the lower arm 52, the control arm 58, and an engagement mechanism initially rotate relative to the upper arm 28 as an interconnected unit 73 about the main pivot 40. A main spring 74, illustrated as a main leaf spring, reacts between this interconnected unit 73 and the upper arm 28, and specifically between the jaw arm 34 and the upper arm 28. The main leaf spring 74 biases the interconnected unit 73 away from the upper arm 28, so that the jaws 24 and 26 are normally spread apart to receive the workpiece 22 therebetween. The squeezing hand force of the user grasping the upper arm 28 through the upper arm pad 54, and the lower arm 52 through the lower arm pad 56, overcomes this biasing force of the main leaf spring 74 to achieve the initial contact and initial grasping of the workpiece 22 between the jaws 24 and 26.

In the preferred form of the pliers 20, the upper control-arm pivot pin 64 is selectively movable generally (but not precisely) parallel to a line extending between the first end 30 and the second end 32 of the upper arm 28. This movement serves to adjust the maximum clamping force exerted by the jaws 24 and 26 on the workpiece 22, when the workpiece 22 is clamped between the jaws 24 and 26, by changing the geometry of the linkage between the jaw arm 34, the lower arm 52, and the control arm 58. The movement and adjustability are achieved by slidably supporting the upper control arm pivot pin 64 in a pin slot 80 (FIG. 5) in the jaw arm 34.

As best seen in FIG. 5, a force adjuster 84 extends from the second end 32 of the upper arm 28. The force adjuster 84 is a knob, preferably a knurled knob, accessible to the fingers of the user of pliers and having an integral threaded shaft 85 that extends through and is threadably engaged to the pivot block 82. An end of the threaded shaft 85 remote from the force adjuster 84 has a dome shape that is forced against the upper control-arm pivot pin 64. When the force adjuster 84 is turned, the shaft 85 drives the upper control-arm pivot pin 64 along the pin slot 80, in a direction generally (but not exactly) parallel to the line extending between the first end 30 and the second end 32 of the upper arm 28.

An engagement mechanism 86 (FIG. 6) releasably engages the jaw arm 34 to the upper arm 28, and specifically to the support engagement 46 of the support 44. The releasable engagement is made at an engagement position responsive to a movement of the jaw arm 34 relative to the upper arm 28 and responsive to a size of the workpiece 22 grasped between the upper jaw 24 and the lower jaw 26. (As will be discussed, the preferred engagement mechanism 86 includes a shifter and a pawl, and their related structure.) This engagement prevents further gross rotation of the jaw arm 34 and the remainder of the interconnected unit 73 relative to the upper arm 28 when the workpiece 22 is so grasped with the clamping force determined by the position of the upper control-arm pivot pin 64 in the pin slot 80, although there is a further minor rotation of the jaw arm 34. That is, when the jaws 24 and 26 are separated further than the size of the workpiece 22, the force of the hand of the user on the pads 54 and 56 causes the jaws 24 and 26 to close to contact the workpiece 22 by the rotation of the interconnected unit 73 relative to the upper arm 28 about the main pivot 40. When the jaws 24 and 26 contact the workpiece 22 and as there is an initial application of a small clamping force to the workpiece 22, the engagement mechanism 86 automatically operates to engage the jaw arm 34 and the interconnected unit 73 to the support 44 and thence to the upper arm 28, so that there is no further gross rotation of the interconnected unit 73. The pliers 20 is thereby automatically adjustable to the size of the workpiece 22 being grasped.

The engagement mechanism 86 includes a pivotably supported pawl 88 (FIG. 3). The pawl 88 rides on the jaw arm 34 in the support engagement slot 48 in facing relation to the support engagement teeth 50. The pawl 88 has pawl teeth 90 thereon. Prior to engagement, the pawl 88 is separated from a side 51 of the support engagement slot 48 that is nearest the jaws 24 and 26. During engagement, the pawl 88 is moved into contact with the side 51 so that the pawl teeth 90 mesh with the support engagement teeth 50 to prevent further upward gross motion of the jaw arm 34. A restraining plate 140 overlies a portion of the pawl 88, holds the pawl on its pawl pivot pin 93, and serves to align and guide the movement of the pawl 88.

The engagement mechanism 86 also includes the shifter 92. The shifter 92, shown in detail in FIG. 6, transfers the force applied to the lower arm 52 by the hand of the user, from the lower arm 52 to the lower jaw 26. Additionally, the shifter 92 pivotably supports the pawl 88 on the pawl pivot pin 93 that extends through the shifter 92 and the pawl 88, activates the pawl 88, and engages the pawl 88 to the support 44 of the upper arm 28 when the workpiece 22 is contacted by the jaws 24 and 26. This engagement is responsive to the movement of the jaw arm 34 relative to the upper arm 28 and responsive to the size of the workpiece 22 grasped between the upper jaw 24 and the lower jaw 26.

The shifter 92 is in the form of a thin plate that transfers force. The shifter 92 has three pivot points, including the pawl pivot pin 93, a pinned pivot point 94, and a contact face 98 thereon arranged in a triangular pattern. The pawl pivot pin 93 becomes a pivot point after the pawl 88 is engaged to the support 44, but not prior to that engagement. The pivot pin 94 is pivotably connected by a pin to the lower arm 52 at a shifter pin pivot 100. The contact face 98 pivots and slides against, but is not pinned to, the jaw arm 34 at a contact face 104. The pawl 88 is pivotably connected to the central portion of the shifter 92 at the pawl pivot pin 93. (The pawl 88 is not shown in FIG. 4 and 6, because it would obscure the view of the shifter 92, but it is shown in FIG. 3.) The shifter 92 thereby provides the force transfer between the lower arm 52, the pawl 88, and the lower jaw 26. That is, the lower jaw 26 is not integral with the lower arm 52, but instead is linked to it by a linkage provided by the shifter 92, in this embodiment.

In operation, starting with the jaws 24 and 26 at their greatest separation, the user grasps the upper arm 28 and the lower arm 52 and moves them toward each other. The interconnected unit 73 rotates relative to the upper arm 28 as a rigid interconnected structure around the main pivot 40. The geometric relationships of the element of the interconnected unit 73, including the jaw arm 34, the lower arm 52, the control arm 58, and the engagement mechanism 86, is kept rigid by means of an anti-squat mechanism 120 during this initial rotation. The anti-squat mechanism 120 includes the contact face 96 of the shifter 92, and the contact face 102 of the lower jaw 26. An anti-squat spring 122, illustrated as an anti-squat leaf spring, reacting against an upper surface 126 of the shifter 92, holds the contact faces 96 and 102 in contact during this period of rotation of the interconnected unit 73. By keeping the contact faces of 102 and 96 in contact until the lower jaw 26 and the upper jaw face 24 contact the workpiece 22, the anti-squat mechanism 120 keeps the interconnected unit 73 geometrically rigid until the jaws 24 and 26 touch and begin to apply force to the work piece 22, and additionally prevents the rotation of the shifter 92.

After the jaws 24 and 26 have contacted the workpiece 22 and have begun to apply a contact force into the workpiece 22, the contact face 96 lifts up and away from the contact face 102 that is part of the lower jaw 26, against the biasing force of the anti-squat leaf spring 122. The shifter 92 rotates clockwise (in the view of the drawings) about the pivot established between the contact surface 98 and the contact face 104. The pawl 88 rotates clockwise about the pawl pivot pin 93 and moves toward the lower jaw 26 to engage the pawl teeth 90 to the support engagement teeth 50. This engagement of the pawl teeth 90 to the support engagement teeth 50 halts further gross rotation and motion of the interconnected unit 73.

For most applications, it is desirable that the contacting force of the jaws 24 and 26 to the workpiece 22 be large in order to ensure that the workpiece is firmly held. To accomplish that result, the shifter achieves a force-multiplier effect wherein the contact force applied to the workpiece 22 is significantly greater than the force produced by the grasping action of the hand of the user. With the illustrated design, the force multiplier is on the order of about 3–4 when friction and other effects are considered, although higher force multipliers are possible in other designs. The force multiplication arises as follows. Once the pawl teeth 90 are engaged to the support engagement teeth 50, the rotational pivot point of the shifter 92 is transferred form the contact face 98 of the shifter 92 to the pawl pivot pin 93. The contact face 98 rides on the included contact face 104. The shifter 92 continues to rotate about the pivot pin 93 as the lower arm 52 is moved toward the upper arm 28, producing a further minor rotation of the jaw arm 34. The hand force of the user moving over a longer distance is transferred into the lower jaw 26, which moves a shorter distance but with greater contact force applied to the workpiece 22, than the hand force of the user. The force multiplication is achieved because the contact faces 98 and 104 act as an inclined plane as the shifter 92 rotates. The difference in the length of the lever arm between the locations 93–98 and 93–94 also contributes to the force multiplication.

The release of the force on the lower arm 52 reverses this process, causes the shifter 92 to rotate counterclockwise, disengages the pawl teeth 90 form the engagement teeth 50, allows the lower jaw 26 to move downwardly, and disengages the jaws 24 and 26 from the workpiece 22.

In the use of the pliers 20 just discussed, the jaws 24 and 26 engage and hold the workpiece 22 such that release of the pressure applied to the upper arm 28 and the lower arm 52 immediately releases the workpiece 22. In another embodiment, the jaws 24, 26 may be engaged to the workpiece 22 and releasably locked to the workpiece 22 by a locking mechanism 150, which in this case is an overcenter locking mechanism.

The overcenter locking mechanism 150 incorporates an unlocking lobe 106 on the lower side of the control arm 58. A release arm 108 is pivotably connected to the end of the lower arm 52 remote from shifter 92, and is accessible to the hand of the user of the pliers 20. A release pad 110 is located on the upper side of the release arm 108 (FIG. 2) and is disposed to contact the unlocking lobe 106 when the release arm 108 is rotated. In operation, when the lower arm 52 is moved upwardly to the limit of its travel established by the operation of the engagement mechanism 86, the lower control arm pivot point 66 moves to an overcenter position relative to the upper control-arm pivot pin 64 and the pivot pin 94. Stated alternatively, when the lower arm 52 is fully open (moved to its downward limit of travel) as in FIG. 1, the lower control arm pivot point 66 lies below a straight line drawn between the upper contact-arm pivot pin 64 and the pivot point 94. As the lower arm 52 is moved upwardly, the lower control arm pivot point 66 moves closer to a straight-line relationship between the pivot pins 64 and 94, and eventually crosses over that straight line to lie above the straight line drawn between the pivot pins 64 and 94. This is the overcenter lock position. To release the pliers 20 from this overcenter lock position, the release arm 108 is operated to rotate the release pad 110 upwardly against the unlocking lobe 106, to thereby force the lower arm 52 downwardly and out of the overcenter relationship. This type of overcenter locking capability may be provided instead of or in addition to the engaging-but-non-locking embodiment described previously.

The embodiment of FIGS. 1–4 includes a locking engagement control 112 that allows the pliers 20 to be selectively shifted between a non-locking version and a locking/release version. The locking engagement control 112 includes an overcenter lock selector 114 that enables the release arm 108 to move along a track 124 between a locking position and a non-locking position. In the non-locking position, an overcenter blocking pad 111 on the release arm 108 is positioned to contact the unlocking lobe 106 to block the movement of the control arm 58 that is required to reach the overcenter locked position. In this position, the pliers 20 functions to grasp the workpiece 22 between the jaws 24 and 26, but does not lock the jaws 24 and 26 against the workpiece 22. When the force is released from the arms 28 and 52, the workpiece 22 is released. In the locking position, the overcenter lock selector 114 is repositioned to move the release arm 108 in the track 124 so that the overcenter blocking pad 111 does not block the movement of the control arm 58 that is required to reach the overcenter locked position. This allows the force on the arms 28 and 52 to cause the jaws 24 and 26 first to grasp and, then with continued force, allows overcenter motion of control arm 58 to allow the jaws to lock onto the workpiece 22. Release of the force on the arms 28 and 52 does not itself cause the jaws 24 and 26 to release from the workpiece 22. Instead, to unlock the jaws the release arm 108 is pivoted to cause release pad 110 to contact the unlocking lobe 106 and push the lower arm 52 away from the control arm 58. The contacting force applied by the jaws 24 and 26 to the workpiece 22 is thereby released, and the disengagement of the jaws 24 and 26 from the workpiece proceeds. This ability to readily switch between non-locking and locking pliers is an important advantage of the invention.

As illustrated the overcenter lock selector 114 may comprise a generally rectangular pin secured to, and movable with, release arm 108. The pin is located in and is slidable along the slot 124, which extends generally longitudinally along the lower arm 52, to permit longitudinal motion of the release arm 108. This allows arm 108 to be shifted lengthwise along arm 52 to switch the pliers between the non-locking mode of operation in the forward position (illustrated in FIG. 4) and the locking/release mode of operation in the rearward position. The pin 114 and the forward and rearward ends of the slot are angled slightly with respect to the generally longitudinal direction of the slot 124 to provide latching regions which receive the pin to secure the release arm in either its forward or rearward positions. The release arm is pivoted clockwise to align the pin 114 with the slot 124 to allow the arm to move back and forth along the slot to switch the pliers between the locking and non-locking modes.

For either the engaging-only or the engaging-and-locking embodiments, it is often helpful to know whether the maximum permissible clamping force, as determined by the position of the upper contact-arm pivot pin 64, has been applied through the jaws 24 and 26 to the workpiece 22. In the presently preferred approach, a force indicator window 130 is provided through each of the sides of the lower arm 52. When the control arm 58 has been sufficiently rotated to correspond to the maximum permissible clamping force, a force indicator 132 is visible through the force indicator window 130. The force indicator 132 is preferably a region of contrasting color on a projection on the side of the control arm 58, for example, a yellow force indicator 132 on a black metallic control arm 58. If the control arm 58 is only partially rotated toward the position associated with less than the maximum contact force on the workpiece 22, the force indicator 132 is not visible through the force indicator window 130. If the control arm 58 is fully rotated to the position associated with the maximum contact force on the workpiece 22, the force indicator 132 is visible through the force indicator window 130, giving an indication of this force status of the user of the pliers 20.

A modification of the selective overcenter locking and release mechanism 150 described above is illustrated in FIG.

7, and is described in detail in the aforesaid parent application Ser. No. 09/334,055, now U.S. Pat. No. 6,212,978. In this embodiment, an unlocking lobe 160 is located on a control arm 162 of the pliers 164. A release arm 166 is pivotably connected to the lower arm 168, at a location between the first end (not shown) and the second end 170 and accessible to the hand of the user of the pliers at the second end 170. A release pad 172 on the upper side of the release arm is disposed to contact the unlocking lobe 160. In operation the lower control arm pivot pin 174 moves to an overcenter position relative to an upper control arm pivot pin when the lower arm 168 is moved upwardly to the limit of its travel. Stated alternatively, when the lower arm is fully open (moved to its downward limit of travel), the lower control arm pivot pin 174 lies below a straight line drawn between the upper control arm pivot pin and the lower arm pivot pin. As the lower handle is moved upwardly, the pivot pins move closer to a straight-line relationship, and eventually pin 174 crosses over that straight line to the overcenter lock position. To release the pliers from this overcenter lock position, the release arm 166 is operated to rotate the release pad 172 upwardly against the unlocking lobe 160, and thereby forces the lower arm 168 downwardly and out of the overcenter relationship.

Figure 7:
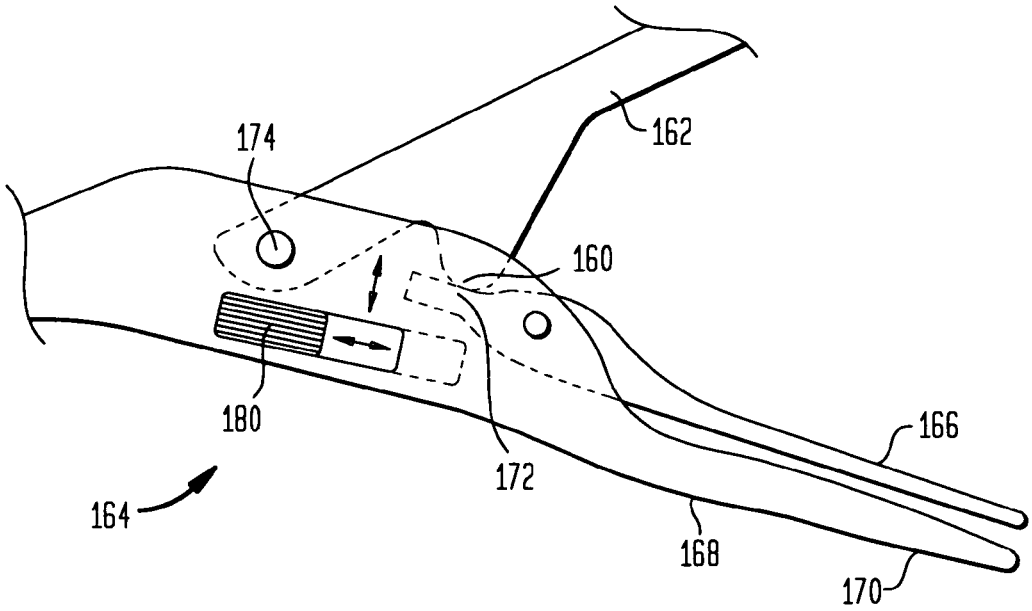
FIG. 7 is a partial elevational view of a pliers incorporating a modified overcenter lock switch mechanism.

The embodiment of FIG. 7 allows the pliers to be selectively shifted between the non-locking version and the locking/release version. A lock switch 180 is provided to selectively prevent the pivoting movement of the release arm 166. That is, when the movement of the pliers control arm 162 passes into the overcenter relationship, the release arm 166 is forced to pivot in the direction (counter-clockwise in the embodiment of FIG. 7) opposite to the pivoting movement of the release arm during unlocking (clockwise in FIG. 7). The locking function may be prevented by preventing this movement of the release arm 166 as the movement reaches the overcenter position as the jaws are closed, so that the stationary release arm 166 prevents the movement of the control arm 162 from passing to the overcenter position. The lock switch 180 prevents the movement of the release arm and the control arm by physically contacting and interfering with the movement of the release arm. Thus, in the embodiment of FIG. 7, the lock switch 180 slides into an interfering position relative to the release arm when slid to the right, so that the overcenter locking is not permitted. The pliers then serves as an ordinary non-locking pliers. When the lock switch is slid to the left in the view of FIG. 7, it does not interfere with the rotation of the release arm, and the release arm does not prevent the movement of the lobe 160 and thence the control arm 162 as it passes to the overcenter position. The pliers is a locking pliers in this configuration.

Another modification of the selective overcenter lock mechanism is illustrated in FIGS. 8–13, and is further described in parent application Ser. No. 09/594,191, now U.S. Pat. No. 6,279,431 and in parent application Ser. No. 09/942,095, now U.S. Pat. No. 6,748,829. These figures are partial views to illustrate a lock mechanism 190 which is similar to those described above for pliers 20 and 164. In this embodiment, the pliers 192 incorporates a lower arm 194 having an end 196 and a control arm 198 having a lobe 200 similar to those described above, with the control arm being pivotally connected to the lower arm 194 at pivot pin 202. The release arm 108 and its associated structure described above is replaced by a shaped overcenter lock switch mechanism 240, which has some of the same functionality as the release arm 108. The overcenter lock switch mechanism 240 includes a contact surface 242 at the end of an overcenter-limiting arm 244. The overcenter-limiting arm 244 is affixed to the lower arm 194 at a location adjacent to the second end 196 thereof. The overcenter-limiting arm 244 is affixed to the lower arm 194 by any operable approach, such as an illustrated slider pin 246 in a slot 248. Other affixing approaches include, for example, a hinge mechanism and a slotted receiver such as discussed above and often used at the jaw end of a conventional pliers. The movement of the overcenter-limiting arm 244 on the slider pin 246 or other affixing approach allows the overcenter-limiting arm 244, and thence the contact surface 242, to be positioned relative to the lobe 200 to allow an overcenter locking function or to prevent an overcenter locking function, depending upon the positioning. A leaf spring 250 extends between the overcenter-limiting arm 244 and the lower arm 194 to bias the overcenter-limiting arm 244 in the straight extended position.

Figure 8:
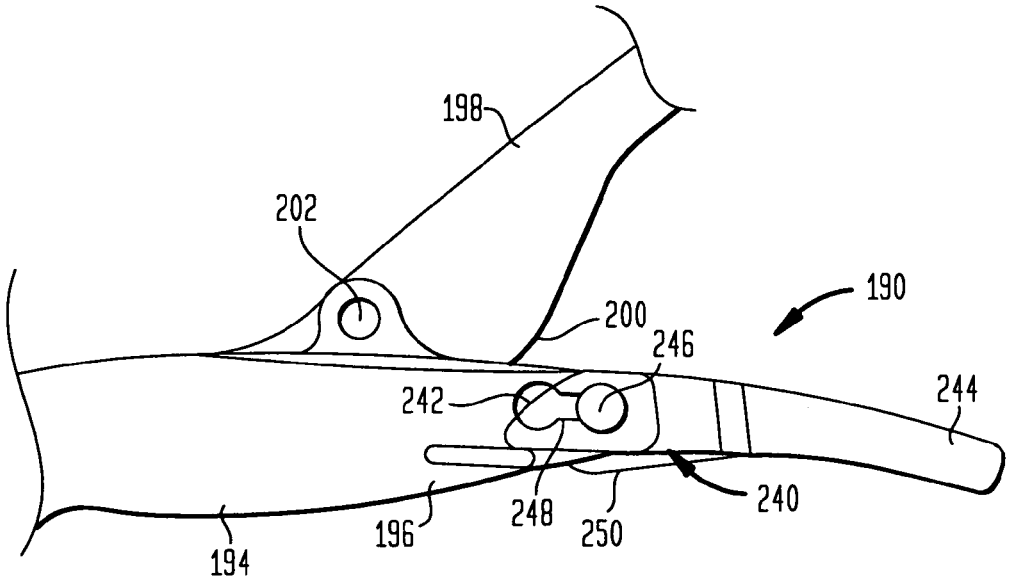
FIGS. 8–11 are a series of partial schematic elevational views of a modified switchable overcenter locking mechanism in the lock mode.
Figure 9:
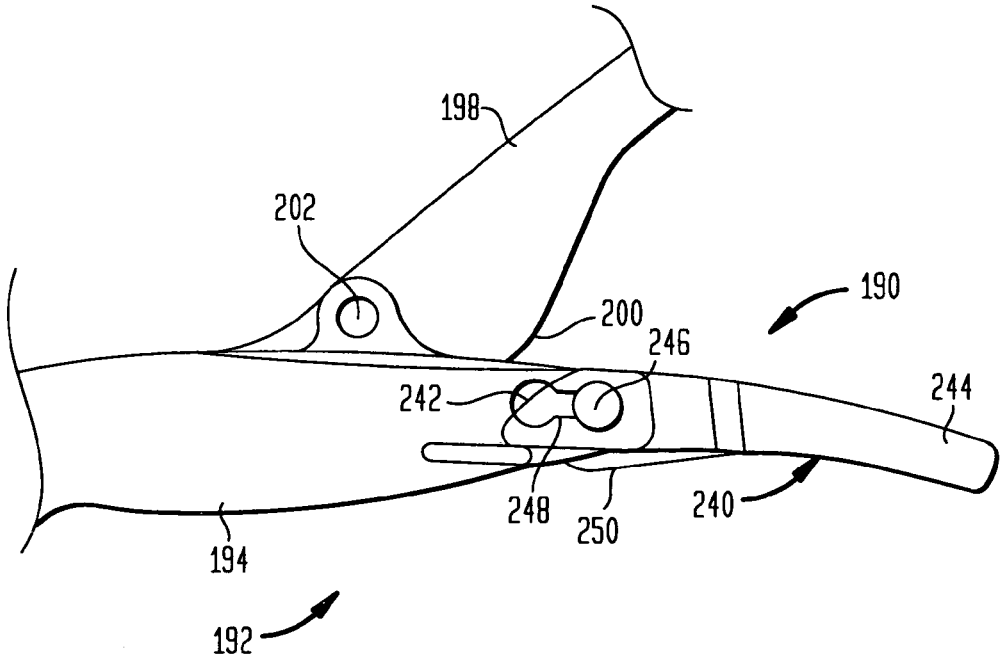
Figure 10:
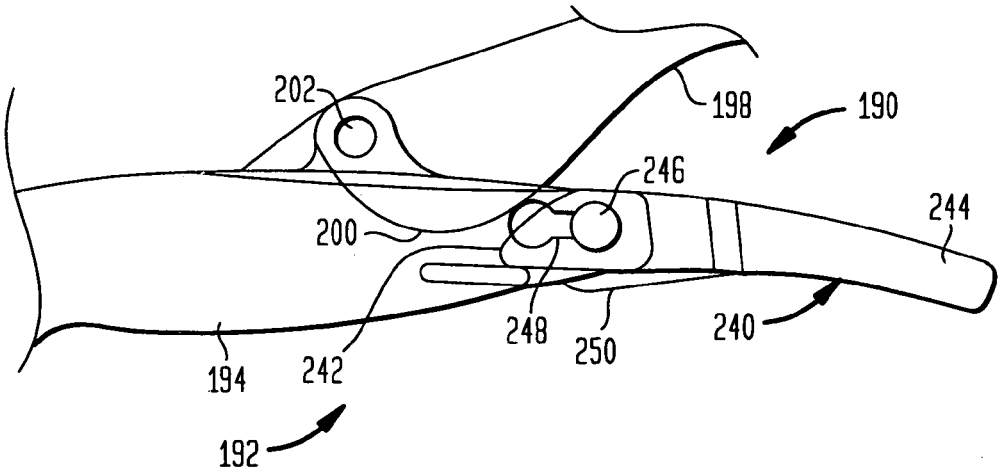
Figure 11:
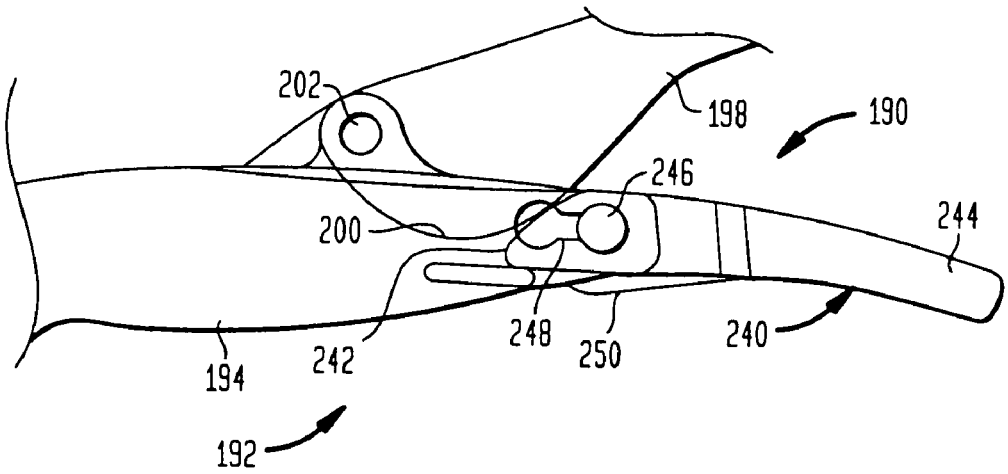
Figure 12:
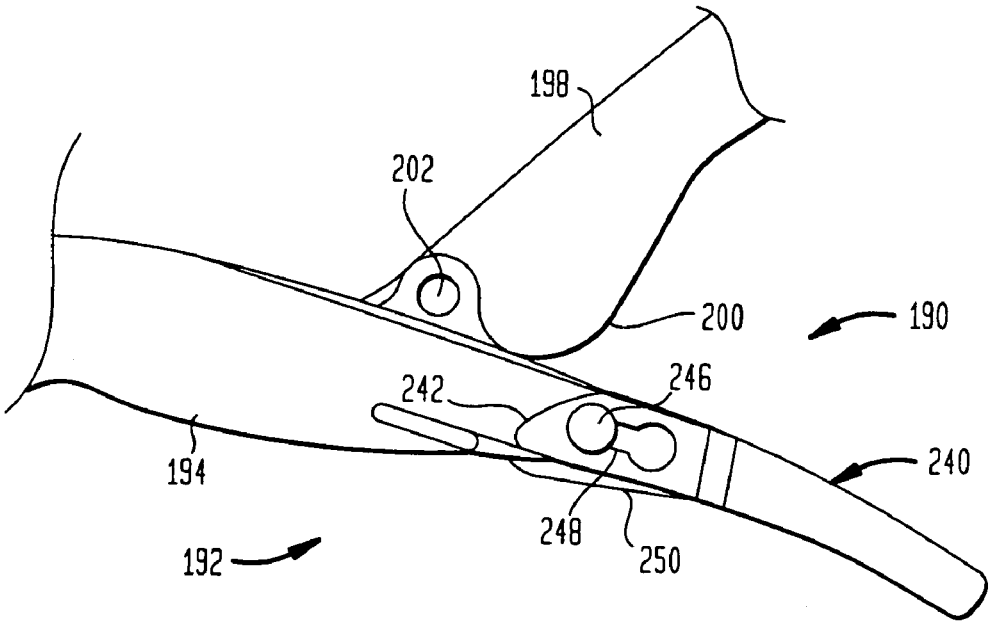
FIGS. 12–15 are a series of partial schematic elevational views of the switchable overcenter locking mechanism of FIGS. 8–11 in the non-locking mode.
Figure 13:
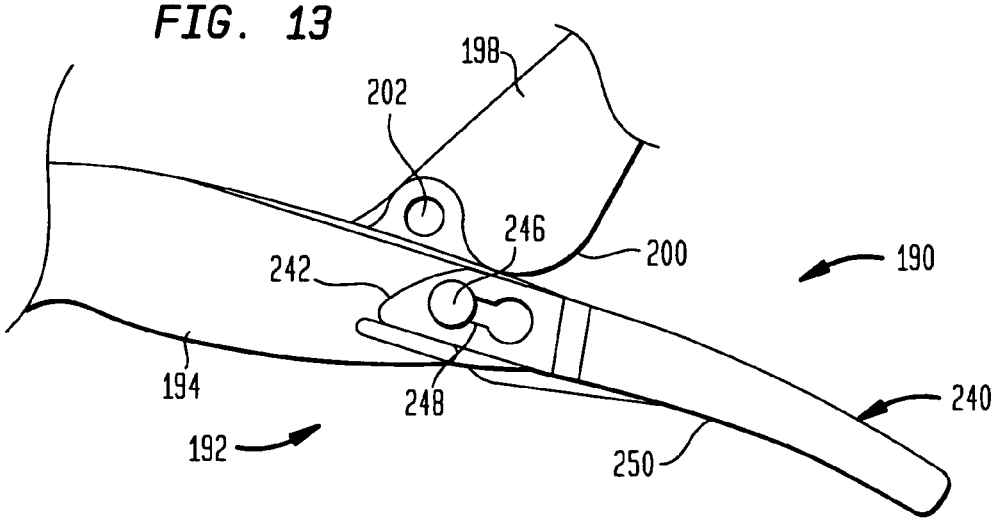
Figure 14:
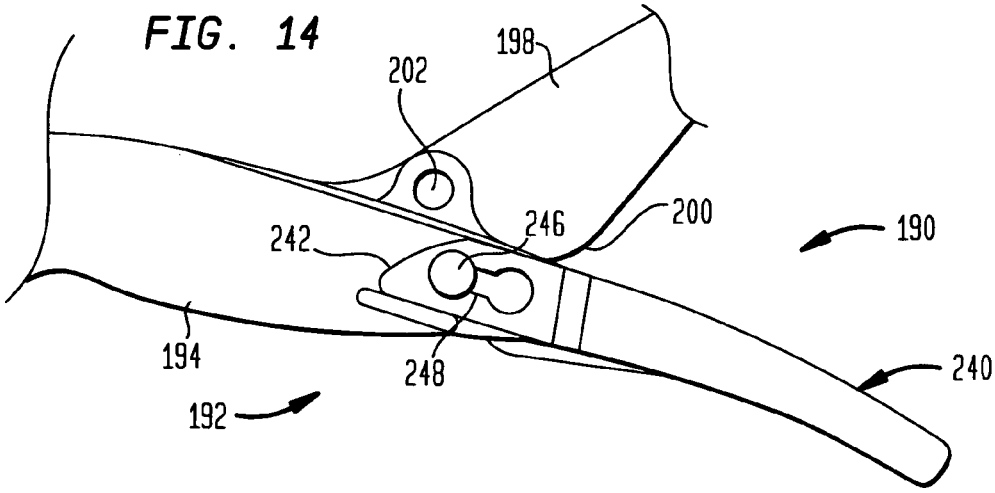
Figure 15:
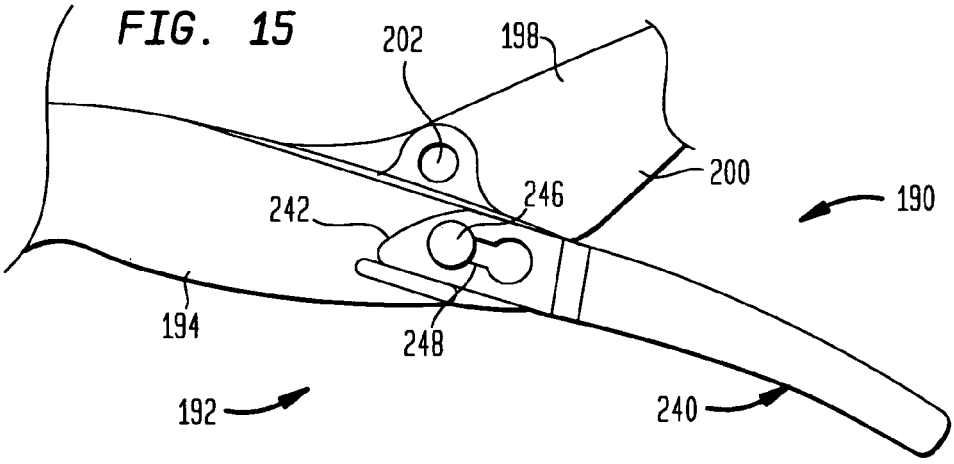

FIGS. 8–11 sequentially illustrate the operation of the pliers when the overcenter-limiting arm 244 is moved to its rearward position on the slider pin 246. In FIG. 8, the lower jaw of the plier is separated from the workpiece (not shown) so that no force is applied to the pliers arms. In FIG. 9, force is applied through the handles so that the lower handle 194 is moved counterclockwise and the lower jaw of the pliers (not shown) just contacts the workpiece. The contact surface 242 has not contacted the lobe 200. In FIG. 10, the handles are squeezed together, so that a gripping load is applied to the workpiece and the lower arm 192 and pivot point 202 have moved almost, but not quite, to the overcenter position. The contact surface 242 has not contacted the lobe 200, so that in FIG. 11 the lower arm 192 can move further to the overcenter position. At this point, there is contact between the contact surface 242 and the lobe 200, so that the lower arm 192 can not move further. To unlock the overcenter position, the overcenter-limiting arm 244 is rotated against the force of the leaf spring 250, clockwise in the view of FIG. 11, to push the lower arm 192 back through the overcenter position.

FIGS. 12–15 illustrate substantially the same sequence as FIGS. 8–11, except that the overcenter-limiting arm 244 is moved to its forward position on the slider pin 246. Closing the lower handle produces a progression from the fully open position of FIG. 12, to the contacting of the lower jaw of the pliers to the workpiece in FIG. 13, to the near-contact of the contact surface 242 to the lobe 200 in FIG. 14, to the contacting of the contact surface 242 to the lobe 200 in FIG. 15. The contact of the contact surface 242 to the lobe 200 in FIG. 15, before the lower control arm pivot pin 202 reaches the overcenter position, prevents movement to the overcenter position and thereby prevents the engagement of an overcenter lock.

The ability to readily switch between a pliers configuration that permits an overcenter lock, as in FIGS. 8–11, and a pliers configuration that does not permit an overcenter lock, as in FIGS. 12–15, is an important advantage. Some pliers uses, such as the initial tightening of a fitting, are best accomplished without an overcenter lock to permit the user to move the pliers quickly. Then, when the fitting is nearly tightened, the user may switch to the overcenter lock configuration to allow the final tightening to be most easily accomplished.

Although a particular embodiment of the invention has been described in detail for purpose of illustration, various modifications and enhancements may be made without departing from the spirit and scope of the invention. Accordingly, the invention is not to be limited except as by the appended claims.

What is claimed is:

1. A hand tool operable to grasp a workpiece between an upper jaw and a lower jaw, comprising:

first and second arms operably linked to cause relative motion of said upper and lower jaws upon motion of said arms;

a control arm having a first end and a second end, the first end of the control arm being pivotable relative to the first arm, and the second end of the control arm being pivotably connected to the second arm; and a release arm pivotally coupled to the second arm and selectively movable between a first automatically retained position in which the release arm allows pivoting movement of the second arm relative to the control arm to allow said hand tool to reach an overcenter lock position, and a second automatically retained position in which the release arm prevents pivoting movement of the second arm relative to the control arm to prevent said hand tool from reaching the overcenter lock position, the release arm also being operable from said first position to manually release said hand tool from the overcenter lock position once said hand tool has been placed in the overcenter lock position by engaging said control arm and forcing said second arm away from said control arm.

2. The hand tool of claim 1, wherein said release arm is selectively slidable to engage said control arm to prevent said control arm from reaching the overcenter lock position.

3. The hand tool of claim 2, wherein said release arm further includes a mounting pin secured to said release arm and slidable in a slot on said second arm to allow the release arm to move between the first position and the second position.

4. The hand tool of claim 3, wherein said slot extends generally along a length of said second arm and includes forward and rearward latching regions for securing said pin.

5. The hand tool of claim 1, wherein said release arm comprises a lock switch movably mounted on said second arm to selectably prevent the control arm from reaching the overcenter lock position.

6. The hand tool of claim 5, wherein said lock switch is mounted to be slidable along said second arm between a non-lock position to prevent the control arm from reaching the overcenter lock position and a lock position to allow the control arm to reach the overcenter lock position, said release arm being pivotal when said lock switch is in its lock position to release the control arm from the overcenter lock position.

7. The hand tool of claim 6, wherein said release arm includes a contact surface for engaging said control arm.

8. The hand tool of claim 7, wherein said contact surface is curved to selectively contact said control arm at a first portion when said lock switch is in its non-lock position and at a second portion when said lock switch is in its lock position, the second portion enabling the release arm to release the control arm from the overcenter lock position.

9. The hand tool of claim 6, wherein said release arm includes a blocking pad portion for engaging said control arm when the lock switch is in its non-lock position and a release pad portion for engaging said control arm when the lock switch is in its lock position.

10. The hand tool of claim 1, wherein said hand tool comprises pliers.

11. A hand tool operable to grasp a workpiece between an upper jaw and a lower jaw, comprising:

first and second arms operably linked to cause relative motion of the upper and lower jaws upon motion of the arms;

a control arm pivotably linked between the first and second arms to control relative motion of the first and second arms into and out of an overcenter lock position;

a release arm pivotally coupled to the second arm and operable to move the first and second arms out of the overcenter lock position and automatically prevent relative motion of the first and second arms into the overcenter lock position; and a switch movable between a first position in which the release arm prevents relative motion of the first and second arms into the overcenter lock position and a second position in which the release arm enables relative motion of the first and second arms into the overcenter lock position.

12. The hand tool of claim 11, wherein the release arm is movable between a first position in which the release arm prevents relative motion of the first and second arms into the overcenter lock position and a second position in which the release arm enables relative motion of the first and second arms into the overcenter lock position.

13. The hand tool of claim 12, wherein the release arm is slidable between the first and second positions.

14. The hand tool of claim 12, wherein the release arm further includes a mounting pin secured to the release arm and slidable in a slot on the second arm to allow the release arm to move between the first position and the second position.

15. The hand tool of claim 14, wherein the slot includes forward and rearward latching regions for securing the pin.

16. The hand tool of claim 11, wherein the release arm is pivotably mounted on the second arm for engaging the control arm and forcing the first and second arms out of the overcenter lock position.

17. The hand tool of claim 11, wherein the switch is slidable between the first and second positions.

18. The hand tool of claim 17, wherein the switch is slidable in a slot on the second arm.

19. The hand tool of claim 17, wherein the switch impedes pivoting motion of the release arm upon contact by the control arm in the first position and enables pivoting motion of the release arm upon contact by the control arm in the second position.

20. The hand tool of claim 11, wherein the hand tool comprises pliers.

21. A hand tool operable to grasp a workpiece between an upper jaw and a lower jaw, comprising:

first and second arms operably linked to cause relative motion of said upper and lower jaws upon motion of said arms;

a control arm having a first end and a second end, the first end of the control arm being pivotable relative to the first arm, and the second end of the control arm being pivotably connected to the second arm;

a release arm selectively movable between a first position in which the arm allows pivoting movement of the second arm relative to the control arm to allow said hand tool to reach an overcenter lock position, and a second position in which the arm prevents pivoting movement of the second arm relative to the control arm to prevent said hand tool from reaching the overcenter lock position, the release arm also being operable to release said hand tool from the overcenter lock position;

wherein said release arm is pivotably mounted on said second arm for engaging said control arm and forcing said second arm away from said control arm to release said hand tool from said overcenter lock position;

wherein said release arm is selectively slidable to engage said control arm to prevent said control arm from reaching the overcenter lock position; and, wherein said release arm further includes a mounting pin secured to said arm and slidable in a slot on said second arm to allow the arm to move between the first position and the second position.

22. The hand tool of claim 21, wherein said slot extends generally along a length of said second arm and includes forward and rearward latching regions for securing said pin.

* * * * *